US009079700B2

(12) United States Patent
Marco et al.

(10) Patent No.: US 9,079,700 B2
(45) Date of Patent: Jul. 14, 2015

(54) CONTAINER CARRIER

(71) Applicants: Leslie S. Marco, Westmont, IL (US); Robert C. Olsen, Medinah, IL (US)

(72) Inventors: Leslie S. Marco, Westmont, IL (US); Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/517,112

(22) Filed: Oct. 17, 2014

(65) Prior Publication Data

US 2015/0108013 A1 Apr. 23, 2015

Related U.S. Application Data

(60) Provisional application No. 61/893,707, filed on Oct. 21, 2013, provisional application No. 61/947,232, filed on Mar. 3, 2014.

(51) Int. Cl.
*B65D 75/00* (2006.01)
*B65D 71/50* (2006.01)

(52) U.S. Cl.
CPC ..... *B65D 71/504* (2013.01)

(58) Field of Classification Search
USPC ..... 206/147, 150, 151, 158, 161, 427
See application file for complete search history.

(56) References Cited

U.S. PATENT DOCUMENTS

| | | | | |
|---|---|---|---|---|
| 4,018,331 | A * | 4/1977 | Klygis | 206/199 |
| 4,782,955 | A | 11/1988 | Weaver et al. | |
| 5,018,620 | A | 5/1991 | Marco et al. | |
| 5,097,650 | A * | 3/1992 | Olsen | 53/398 |
| 5,139,137 | A | 8/1992 | Marco | |
| 2005/0077194 | A1 * | 4/2005 | Marco et al. | 206/139 |
| 2006/0118432 | A1 * | 6/2006 | Weaver et al. | 206/150 |
| 2006/0289315 | A1 * | 12/2006 | Olsen | 206/150 |

FOREIGN PATENT DOCUMENTS

| | | |
|---|---|---|
| EP | 0 142 360 A2 | 5/1985 |
| EP | 0 318 619 A1 | 6/1989 |
| EP | 0 997 389 A1 | 5/2000 |
| EP | 1 004 518 A2 | 5/2000 |

* cited by examiner

*Primary Examiner* — Jacob K Ackun
(74) *Attorney, Agent, or Firm* — Pauley Petersen & Erickson

(57) ABSTRACT

A flexible carrier for carrying a plurality of containers within a plurality of corresponding container receiving apertures formed in longitudinal rows and transverse ranks that includes at least three rows of container receiving apertures wherein a center aperture in middle transverse ranks is longer than an outer aperture in middle transverse ranks and wherein the center aperture in end transverse ranks is wider than the outer container aperture in end transverse ranks.

18 Claims, 3 Drawing Sheets

CONTAINER CARRIER

CROSS REFERENCE TO RELATED APPLICATION

This application claims priority to U.S. Provisional Application, Ser. No. 61/893,707, filed on 21 Oct. 2013 and U.S. Provisional Application, Ser. No. 61/947,232, filed on 3 Mar. 2014. These U.S. Provisional Applications are hereby incorporated by reference herein in its entirety and are made a part hereof, including but not limited to those portions which specifically appear hereinafter.

BACKGROUND OF THE INVENTION

1. Field of the Invention

This invention relates to a container carrier having at least three rows of container receiving apertures for unitizing a plurality of containers.

2. Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package from the top (called a "top lift carrier") or outwardly from a side of the carrier to enable a consumer to carry the package from the side (called a "side lift carrier").

Typically, larger-capacity carriers result in challenges in application to containers in that carriers having more than two rows tend to open in an undesirable sequence and thus cannot be applied at high speeds. In addition, the resulting package tends to sag at the ends when lifted resulting in a sloppy appearance. As such, a need arises for a carrier capable of carrying a large number of containers that permits high speed application and results in an aesthetically pleasing package for the consumer to handle.

SUMMARY OF THE INVENTION

The present invention is directed to a flexible carrier for packaging containers that includes an arrangement of container receiving apertures that are configured to permit placement over containers in three distinct rows.

The carrier is suitably configured with a combination of webs and container receiving apertures that permit opening up and generally even, distributed stretching for application to the containers. In the described configuration, the shape and width of the outer three container receiving apertures in end ranks are quite different from the central six container receiving apertures in middle ranks. Such a design overcomes the natural tendency of the central apertures to foreshorten during stretching. The resulting carrier is configured to enable placement over at least three rows of containers to result in a tight, unitized bricklike package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 3:
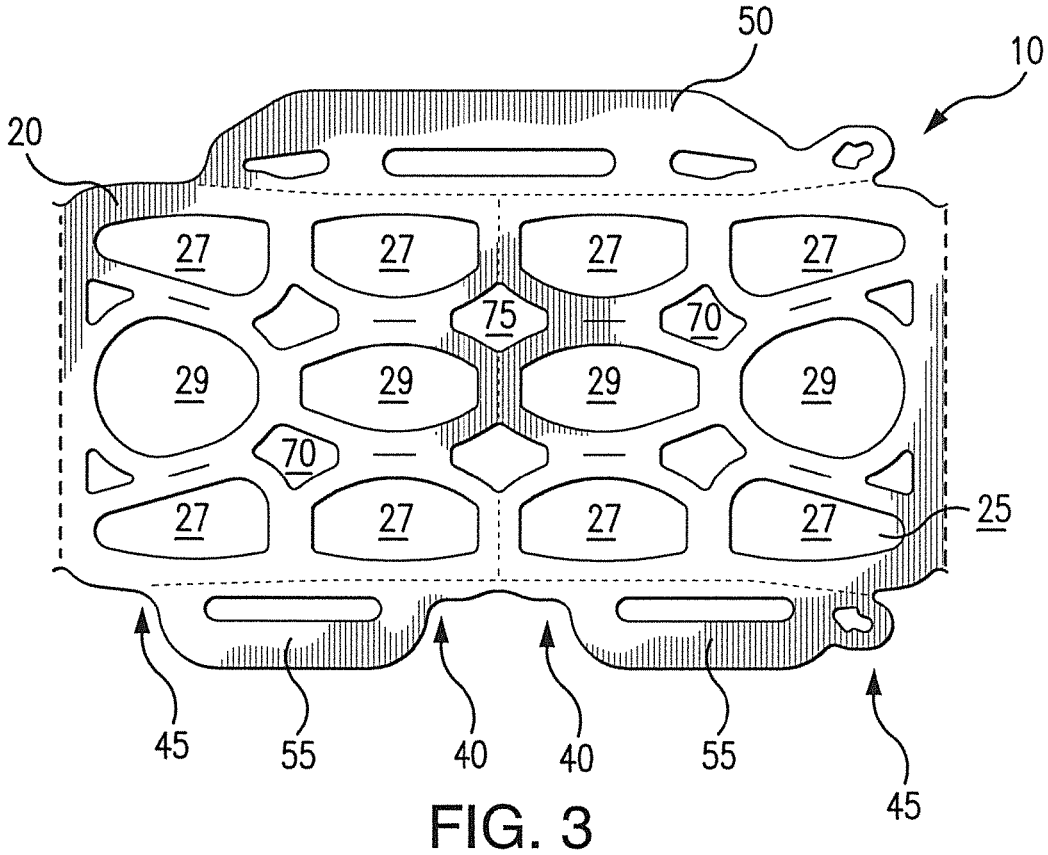
FIG. 3 is a side elevational view of a container carrier according to one preferred embodiment of this invention.
Figure 4:
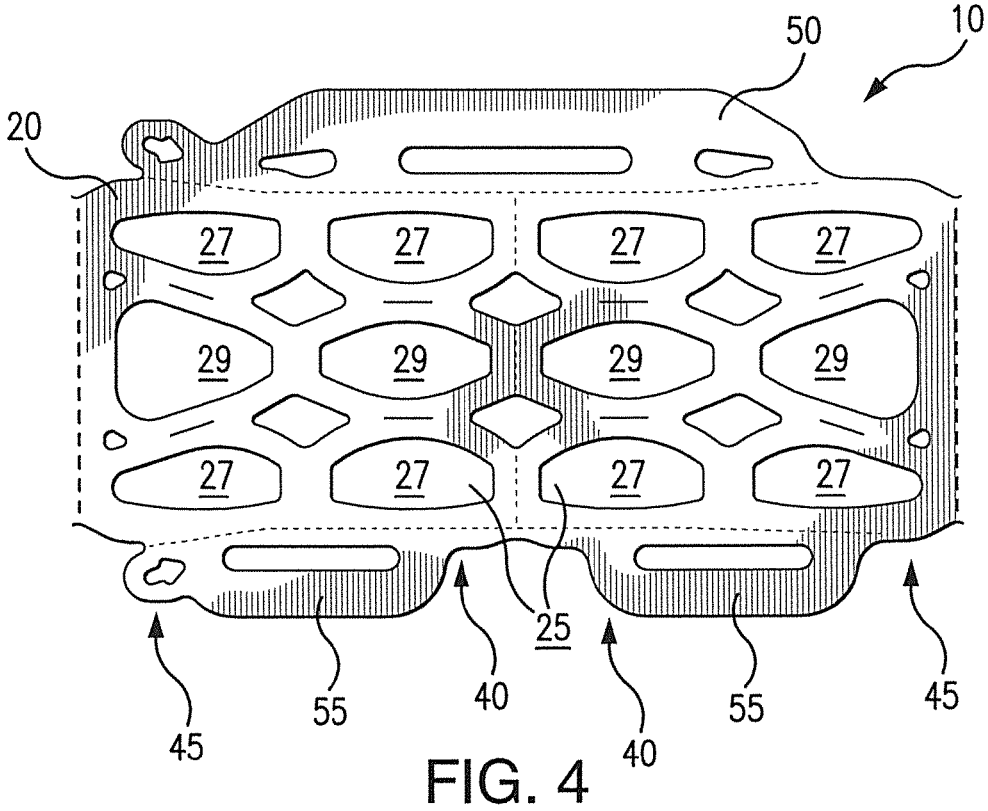
FIG. 4 is a side elevational view of a container carrier according to one preferred embodiment of this invention.
Figure 5:
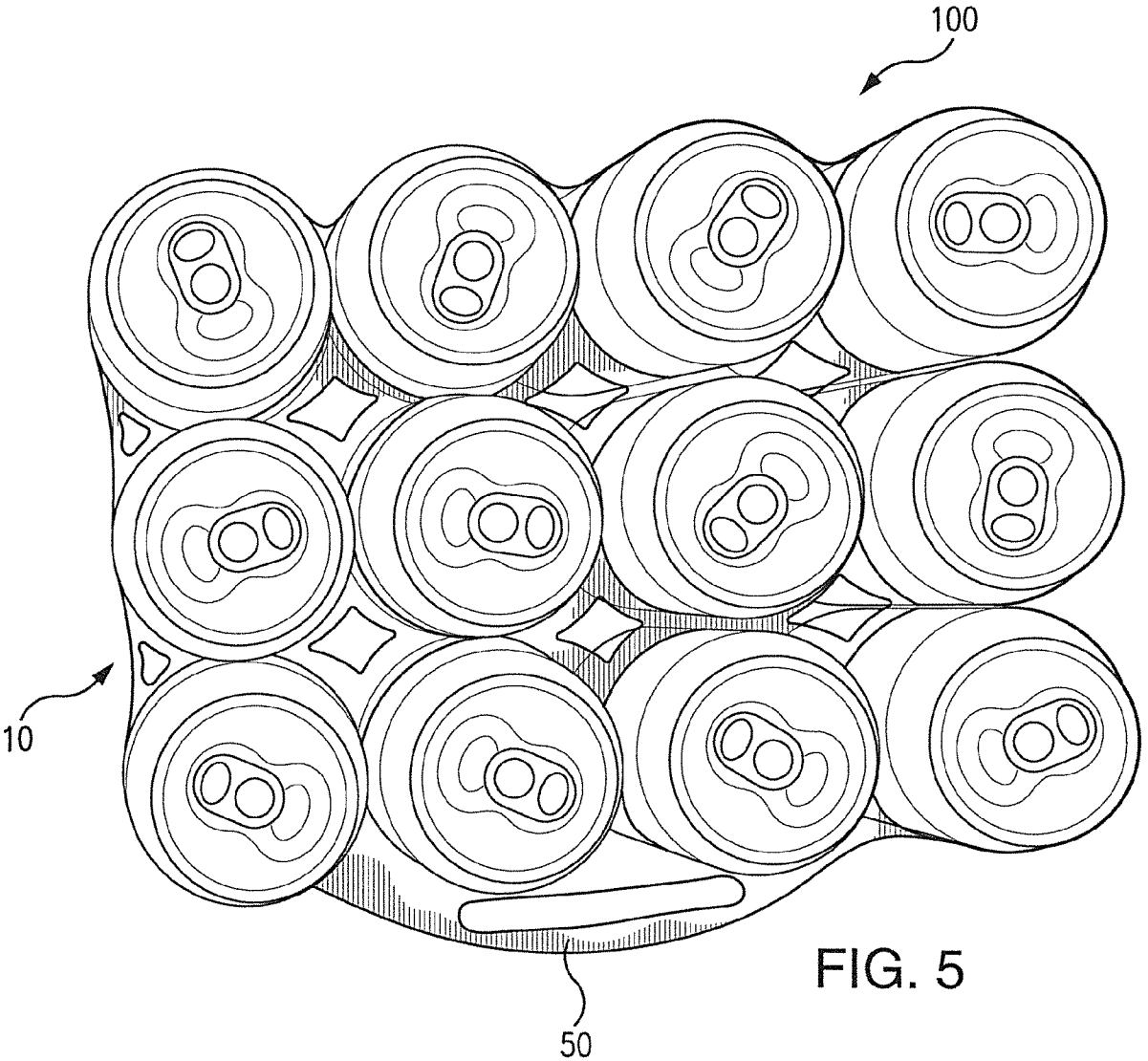
FIG. 5 is a top view of a package of containers according to one preferred embodiment of this invention.

FIGS. 1-4 show flexible carrier 10 for unitizing six or more containers and a resulting unitized package, shown in one embodiment in FIG. 5. Although FIGS. 1-5 illustrate various structures for flexible carrier 10 of the invention, the illustrations are exemplary, and the invention is not limited to the flexible carriers 10 or packages shown for twelve containers. For example, flexible carrier 10 may be alternatively configured and used to unitize six, nine, fifteen, eighteen, or any other desired number of containers.

Containers are preferably cans, however, bottles or any other commonly unitized container may be used with flexible carrier 10 according to this invention. The containers are preferably, though not necessarily, like-sized within a single flexible carrier 10.

Figure 1:
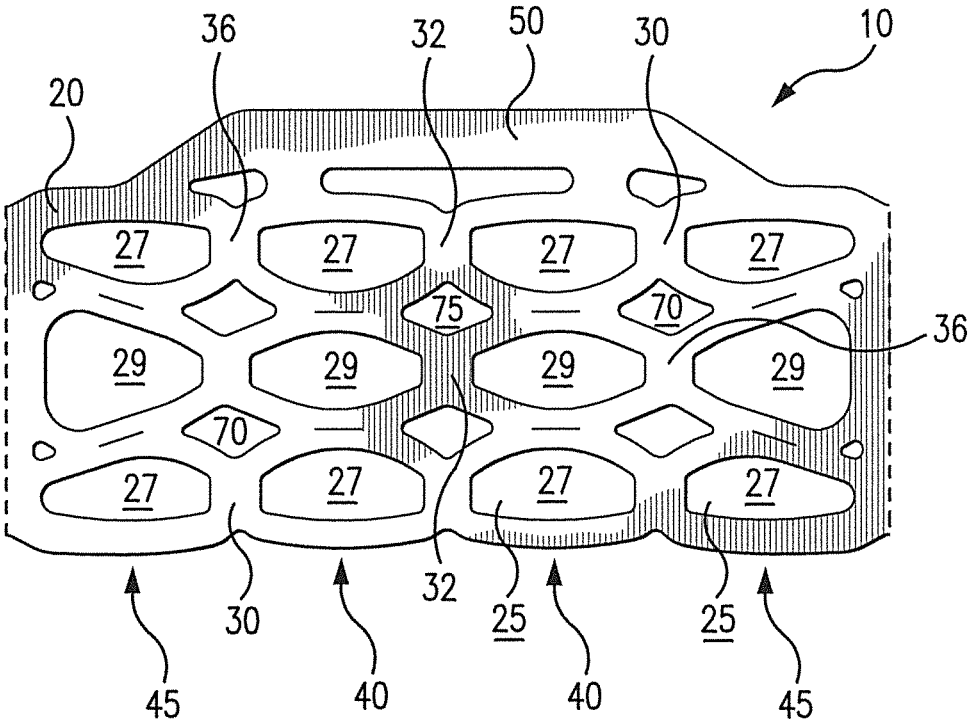
FIG. 1 is a side elevational view of a container carrier according to one preferred embodiment of this invention.
Figure 2:
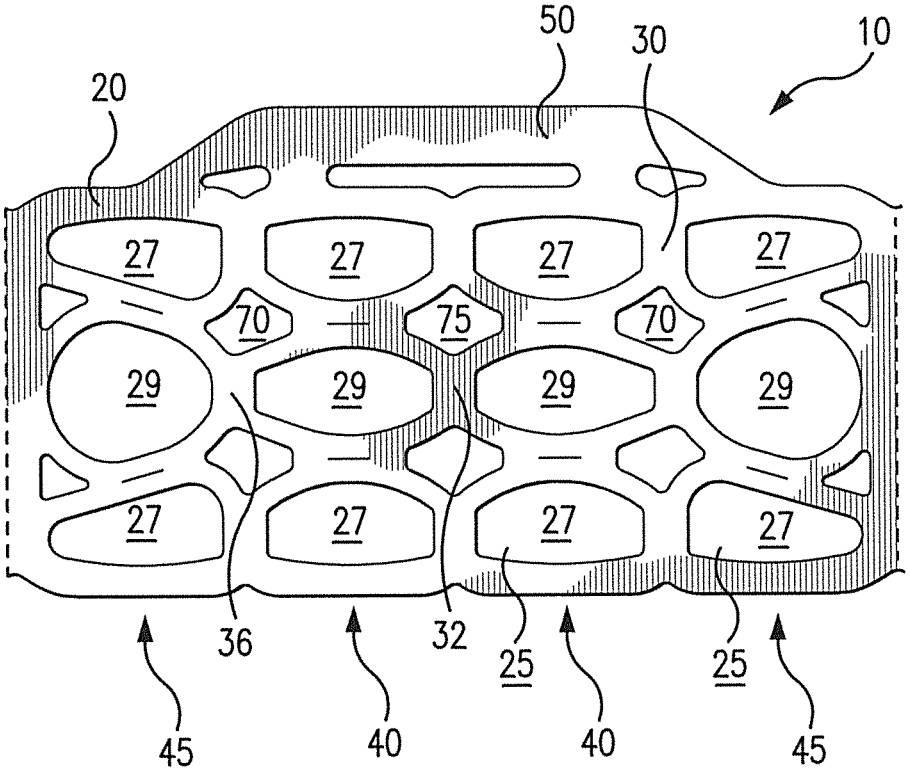
FIG. 2 is a side elevational view of a container carrier according to one preferred embodiment of this invention.

Each flexible carrier 10 preferably includes a single layer of flexible sheet 20 having a width and length defining therein a plurality of container receiving apertures 25, each for receiving a container. The plurality of container receiving apertures 25 are preferably arranged in at least three longitudinal rows and multiple longitudinal ranks so as to form an array of container receiving apertures 25, such as three rows by four ranks for a twelve container multipackage as shown in FIGS. 1 and 2 or three rows by four divisible ranks for a dividable twelve container multipackage as shown in FIGS. 3 and 4. Container receiving apertures 25 are preferably elongated in a longitudinal direction of flexible carrier 10.

The resulting configuration includes at least two middle transverse ranks 40 through a middle area of the carrier and exactly two end transverse ranks 45 on each opposite end of the carrier 10. Each rank preferably includes three container receiving apertures 25 (one for each row in the carrier 10). Of these three container receiving apertures 25 per rank, there are two outer apertures 27 and one center aperture 29 formed therebetween.

As shown in FIGS. 1-4, three parallel rows of container receiving apertures 25 are preferably formed within flexible sheet 20. As such, one row of container receiving apertures 25 is preferably formed along each side of the carrier 10 and one intermediate row is formed therebetween. Container receiving apertures 25 are preferably formed in a geometry that results in a uniform application of the carrier 10 to containers to produce a tight unitization of containers within flexible carrier 10. Such a result is difficult when carrier 10 is engaged with three rows of container receiving apertures 25 over three rows of containers as described herein.

In particular, one or more jaws engage with an edge of the container receiving apertures 25 in outer rows and stretch the carrier open so as to apply the carrier to individual containers. When an intermediate row is formed between the outer rows, the jaws cannot directly engage container receiving apertures in that row which results in inadequate stretching of the container receiving apertures in that row and/or misapplication of the carrier to the plurality of containers. The subject invention is configured to enable that the container receiving apertures 25 in that intermediate row to adequate stretch and engage the associated containers resulting in a desired package shown in FIG. 5.

As described above, container carrier 10 according to a preferred embodiment of the invention includes a series of interconnecting webs 30 that define the plurality of container receiving apertures 25. Webs 30 are stretchable around container during application and recoverable around container following application. Specifically, as described, center webs 32 are located between middle transverse ranks and are wider than outer webs 36 located between middle ranks and end transverse ranks.

As shown in FIGS. 1 and 2, each center aperture 29 in middle transverse ranks 40 is longer than each outer aperture 27 in middle transverse ranks 40. For example, center apertures 29 in end transverse ranks 45 are wider than outer apertures 27 in end transverse ranks 45. Further, as shown in FIGS. 1-4, the center aperture 29 in end transverse ranks 45 preferably tapers wider to an outer extremity of the container carrier 10 and outer apertures 27 in end transverse ranks 45 taper narrower to an outer extremity of the container carrier 10. Partially as a result, center apertures 29 in the end ranks 45 preferably include a different configuration than center apertures 29 in the middle ranks 40.

In addition, according to one embodiment the center apertures 29 in the end ranks 45 are longitudinally asymmetric while the center apertures in the middle ranks 40 are longitudinally symmetric. Also, according to one embodiment, outer apertures 27 in end transverse ranks 45 are longer than outer apertures 36 in middle transverse ranks 40. The particular arrangement of apertures described enables the carrier 10 uniformly open up and stretch for application to containers despite having three rows of container receiving apertures 25.

As shown in FIG. 1, a handle 50 extends from a longitudinal edge of carrier 10. Handle 50 may comprise one or more elongated apertures positioned along the outer periphery of handle 50 or may comprise a similar configuration that provides an ample area for a consumer to grasp by inserting his hand through and still maintain the purpose and integrity of package. As shown in FIGS. 3 and 4, a pair of secondary handles 55 may be positioned along a longitudinal edge of the carrier 10 opposite the edge of the handle 50. As shown in FIGS. 3 and 4, one or both of the handle 50 and/or the secondary handles 55 may be divisible along a line of weakness. In this manner, the package may be configured as a twelve pack or a six pack or any similar combination depending on the number of container receiving openings 25 and the configuration of the handles 50, 55 employed.

As shown in the figures, the container carrier 10 may further include asymmetric dividing apertures 70 positioned between middle ranks 40 and end ranks 45 of container receiving apertures. According to one preferred embodiment, a dividing aperture 75 positioned between middle ranks 40 of container receiving apertures 25 is center offset though symmetrical along a transverse direction of the carrier 10.

The configuration of the carrier 10 described above includes a combination of webs and container receiving apertures that permit opening up and even stretching for application to the containers. In the described configuration, the shape and width of the outer three container receiving apertures in end ranks are quite different from the central six container receiving apertures in middle ranks. Also, the design of the center row container receiving apertures is different from the design of the outer row container receiving apertures. Such a design overcomes the natural tendency of the central apertures to foreshorten during stretching.

A package 100 resulting from flexible carrier 10 includes a plurality of unitized containers such as shown in FIG. 5. Flexible carriers 10 are generally applied to containers by stretching flexible sheet 20 surrounding container receiving apertures 25 around container, and requiring the stretched carrier 10 to recover, thereby providing a tight engagement.

While in the foregoing specification this invention has been described in relation to certain preferred embodiments thereof, and many details have been set forth for purpose of illustration, it will be apparent to those skilled in the art that flexible carrier 10 and package 100 susceptible to additional embodiments and that certain of the details described herein can be varied considerably without departing from the basic principles of the invention.

The invention claimed is:

1. A container carrier for unitizing a plurality of containers comprising:

a flexible web forming a plurality of container receiving apertures arranged in longitudinal rows and transverse ranks wherein a center aperture in middle transverse ranks is longer than an outer aperture in middle transverse ranks and wherein the center aperture in end transverse ranks is wider than the outer container aperture in end transverse ranks.

2. The container carrier of claim 1 wherein the center aperture in end transverse ranks tapers wider to an outer extremity of the container carrier and outer apertures in end transverse ranks taper narrower to an outer extremity of the container carrier.

3. The container carrier of claim 1 further comprising a handle positioned along one longitudinal edge of the flexible web.

4. The container carrier of claim 1 wherein center apertures in the end ranks are shaped differently than center apertures in the middle ranks.

5. The container carrier of claim 1 comprising three rows of container receiving apertures.

6. The container carrier of claim 5 comprising four ranks of container carriers.

7. The container carrier of claim 1 wherein center apertures in the end ranks are longitudinally asymmetric.

8. The container carrier of claim 1 wherein center apertures in the middle ranks are longitudinally symmetric.

9. The container carrier of claim 1 further comprising asymmetric dividing apertures positioned between middle ranks and end ranks of container receiving apertures.

10. The container carrier of claim 1 wherein a dividing aperture positioned between middle ranks of container receiving apertures is center offset.

11. The container carrier of claim 1 wherein outer apertures in end transverse ranks are longer than outer apertures in middle transverse ranks.

12. The container carrier of claim 1 wherein a center web between middle transverse ranks is wider than an outer web between middle and end transverse ranks.

13. A container carrier for unitizing a plurality of containers comprising:

a flexible web forming a plurality of container receiving apertures arranged in three longitudinal rows and four transverse ranks wherein a center aperture in middle transverse ranks is longer than an outer aperture in middle transverse ranks and wherein the center aperture in end transverse ranks is wider than the outer container aperture in end transverse ranks;

wherein the center aperture in end transverse ranks tapers wider to an outer extremity of the container carrier and outer apertures in end transverse ranks taper narrower to an outer extremity of the container carrier; and a handle positioned along one longitudinal edge of the flexible web.

14. The container carrier of claim 13 wherein center apertures in the end ranks are longitudinally asymmetric.

15. The container carrier of claim 13 wherein center apertures in the middle ranks are longitudinally symmetric.

16. The container carrier of claim 13 further comprising asymmetric dividing apertures positioned between middle ranks and end ranks of container receiving apertures.

17. The container carrier of claim 13 further comprising a pair of secondary handles extending along an opposite longitudinal edge as the handle.

18. The container carrier of claim 17 wherein the secondary handles are divisible along a line of weakness.

* * * * *